217-363 SR
1/28/86 OP 4,566,867

United States Patent [19]
Bazan et al.

[11] Patent Number: 4,566,867
[45] Date of Patent: Jan. 28, 1986

[54] DUAL DIAPHRAGM PUMP

[76] Inventors: Alberto Bazan, 4928 Scott's Creek Trail, Duluth, Ga. 30136; Donald M. Murphy, 739 Oak View Ct., Lilburn, Ga. 30093

[21] Appl. No.: 626,915

[22] Filed: Jul. 2, 1984

[51] Int. Cl.[4] ..... F04B 43/06
[52] U.S. Cl. ..... 417/393; 137/625.63; 137/625.37; 137/625.69; 137/596.12; 251/358
[58] Field of Search ..... 417/393; 137/596.12, 137/625.29, 625.37, 625.63, 625.69; 251/358

[56] References Cited

U.S. PATENT DOCUMENTS 4,406,596 9/1983 Budde ..... 417/393

*Primary Examiner*—Leonard E. Smith
*Attorney, Agent, or Firm*—L. Lawton Rogers, III

[57] ABSTRACT

A pneumatically operated reciprocating three-way valve having particular application to a double diaphragm pump. The valve is operative without a lubricating oil mist or the inefficiency resulting from air leakage between the valve piston and cylinder. Sticking and stalling of the valve piston are prevented by deformation of the cylinder under pressure to provide leakage of selected cavities within the valve. The pump also avoids the use of a deicer mist by an adjustable bleed of high pressure air to provide a two-step exhaust.

17 Claims, 11 Drawing Figures

DUAL DIAPHRAGM PUMP

BACKGROUND OF THE INVENTION

This invention relates to pneumatically operated diaphragm pumps and, more particularly, to a method and apparatus for avoiding icing and/or stalling.

Pneumatically driven pumps are well known for their utility and frequently utilize either double acting pistons or diaphragms to alternately compress and expand pump chambers to force the exit of the fluid from one chamber while inducing the entry of additional fluid into the other chamber. Since pneumatically driven pumps do not require an electric or internal combustion engine to drive the pumping chambers, such pumps are particularly useful in locations where combustible or explosive materials are present.

One of the problems generally associated with pumps of this type is icing. The actual air flow patterns through the valves are both transient and highly turbulent as a consequence of cyclic operation of the air distribution valve to effect repeated openings and closings of valve exhaust ports. The air jets through the air valve passages are at times at very high Reynolds numbers and hence in the turbulent flow range. Associated with such highly turbulent flows are both velocity and pressure fluctuations, the mean-square pressure energy of which can approach the magnitude of the operating pressures.

Whenever a gas is expanded from a higher pressure to a lower pressure, a cooling of the gas takes place and internal energy is released, the equation relating pressure (P), velocity (V) and temperature (T) of the gas before (i.e., at time 1) and after expansion (i.e., at time 2) being as follows:

$$P_1V_1/T_1=P_2V_2/T_2$$

In the typical three-way air valve used in controlling the operation of such pumps, $P_1$ and $P_2$ have time-dependent mean values and $P_2$ is further subject to severe turbulent fluctuations about the time-mean pressure values. When the valve is operated in environments of low ambient temperatures and high moisture content, icing conditions often develop.

Known prior art pumps have attacked the problem of ice formation by incorporating an air dryer to remove moisture from the air supply system. However, air dryers are often extremely expensive and only marginally successful in climatic conditions of low temperature and high humidity. The additional drop in operational pressure through the air dryer may also be undesirable.

Others, such as those disclosed in Rosen et al. U.S. Pat. No. 3,635,125 dated Jan. 18, 1972, have provided flexible mufler plates and placed a thermal barrier between the valves and the exhaust ports. Others such as the Nord et al. U.S. Pat. No. 3,176,719 dated Apr. 6, 1965, have sought to physically displace the exhaust ports from the pump. Still others such as the Phinney U.S. Pat. No. 2,944,528 dated July 12, 1960, have used oscillating reeds in the exhaust valve or cavity.

Still another known approach to this icing problem is the use of chemical deicing agents such as ethyl alcohol and ethylene glycol. However, these chemical deicing agents are often marginally successful and also introduce an undesirable environmental condition in introducing ethyl alcohol and ethylene glycol vapors into the ambient air.

In still other known dual diaphragm pumps such as that disclosed in the Budde U.S. Pat. No. 4,406,596 dated Sept. 27, 1983, the two operating air chambers are connected to reduce the pressure level of the air being exhausted.

In one aspect of the present invention, icing is reduced by the controlled bleeding of high pressure air from an internal high pressure chamber to an internal low pressure chamber. The high pressure air furnishes internal energy and thus velocity to the exhaust air and thus mechanically displaces ice as it forms. This air by-pass provides a stepdown release of the motive gas, i.e., it reduces the pressure drop across the valve by increasing the pressure in the low pressure chamber and increases the pressure drop across the outlet aperture to increase exit velocity as indicated above.

Pneumatically operable pumps typically use a source of compressed air which is distributed by a reciprocating three-way valve to drive the pistons or diaphragm in the pumping chambers. Known valves such as described as prior art in the Wilden Pat. No. 3,071,118 generally require lubrication with an oil mist because the metal piston travels in a metal cylinder. The clearance required between such metal parts prevents a tight seal, allowing a high amount of air leakage, making it inefficient. However, the use of an oil mist is undesirable in many applications because of the contamination of the atmosphere and material such as foodstuffs being pumped.

Another known type of control valve such as disclosed in the aforementioned patent to Budde uses a metallic piston with a resilient plastic compression seal which eliminates the need for lubrication. While such resilient piston seal rings or o-rings create a barrier that prevents leakage of the compressed air between the piston and the piston wall, the use thereof in many cases is not cost effective due to the frequency of replacement of the seal rings. Generally, the rings fail because the actual contact surface is extremely small compared to the diameter and weight of the piston, uniformly for vertical piston rings but uneven on the lower part of the ring for horizontal pistons as a result of the force of gravity.

In another aspect, the present invention eliminates the maintenance problems of oil mist free valves by forming the piston seals integrally with the piston of a suitable plastic material such as polytetrafluorethylene (PTFE) or the like. In this way, the contact surface area may be increased relative to the diameter and weight of the piston.

Another problem associated with double diaphragm pumps is the potential for stalling. Stalling is prevented in the present invention by the use of a pilot valve cylinder resiliently deformable under pressure so that air can be bled from a selected one of the potentially opposing chambers of the air distribution valve to thereby ensure operation. In addition, the bleeding of air from a selected valve chamber may be used to slow the speed of reciprocating movement of the air distribution valve piston during the terminal part of a movement thereof. This reduces the impact of the piston on the end walls of the cylinder and thus reduces the potential deformation and sticking of the piston to the end wall.

These and many other objects and advantages of the present invention will be readily apparent to one skilled in the art from the claims, and from the following detailed description when read in conjunction with the appended drawings.

THE DRAWINGS

Figure 9B:
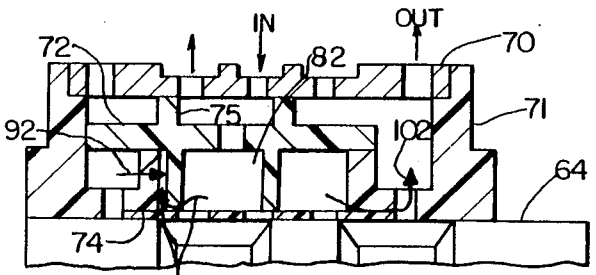
Figure 9C:
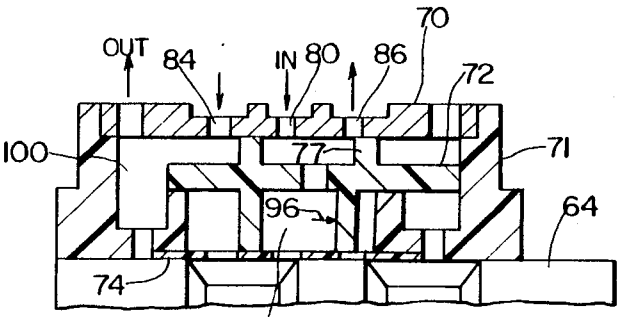
Figure 8:
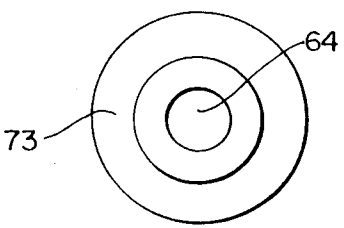
FIG. 8 is an end view of the assembled valve of FIG. 7.
Figure 9A:
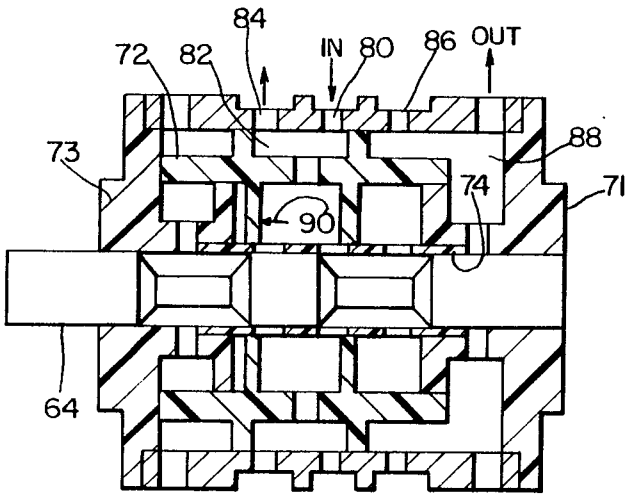
Figure 7:
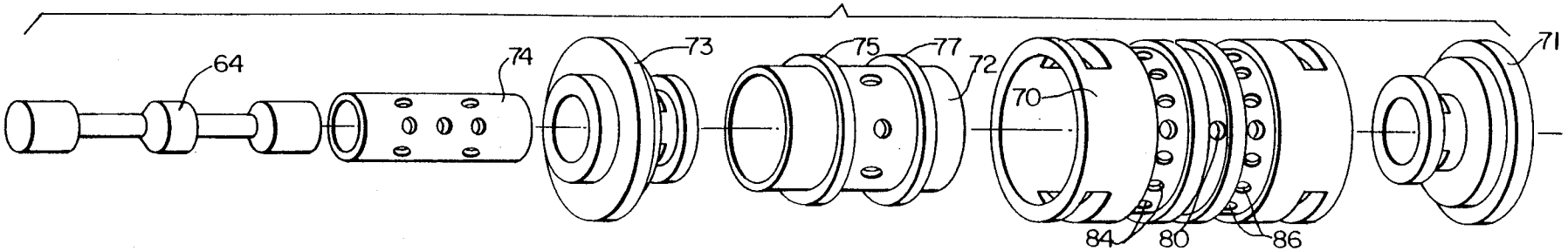
FIG. 7 is an exploded pictorial view of one embodiment of the air distribution valve assembly of the present invention.

FIGS. 9(A)-9(C) are pictorial views in cross-section schematically illustrating the operation of the valve assembly of FIGS. 7 and 8.

THE DETAILED DESCRIPTION

Figure 1:
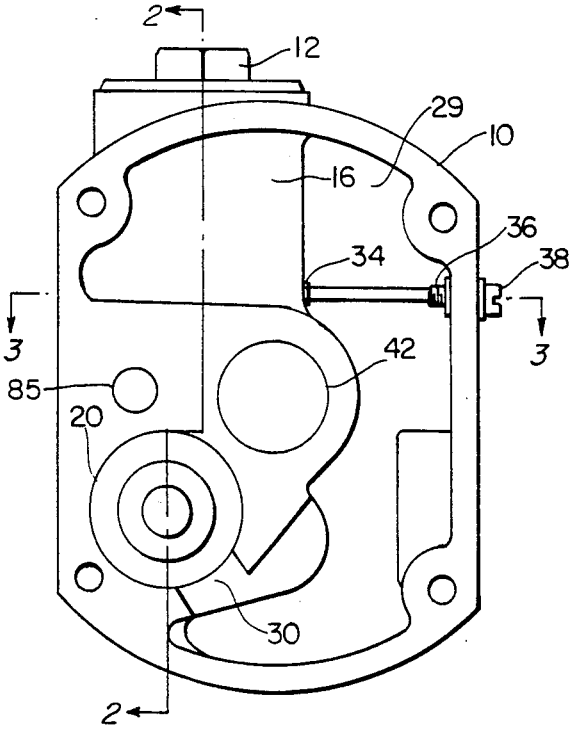
FIG. 1 is a side view in elevation of the pump housing of one embodiment of the pump of the present invention.
Figure 2:
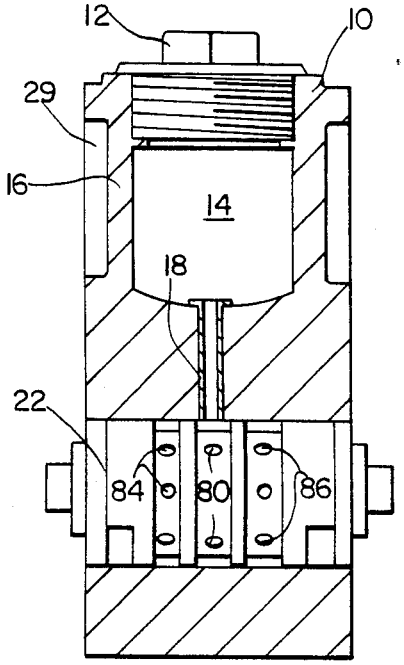
FIG. 2 is a section taken through lines 2—2 of the pump housing of FIG. 1.
Figure 3:
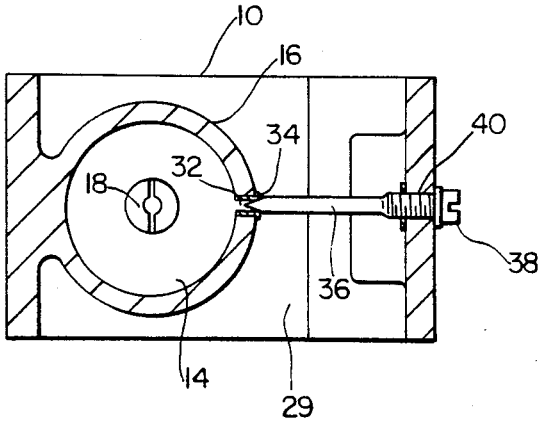
FIG. 3 is a section taken through lines 3—3 of the pump housing of FIG. 1.

With reference to the pump housing illustrated in FIGS. 1, 2 and 3, where like numbers have been used for like elements to facilitate an understanding of the present invention, the housing 10 has an air inlet orifice or aperture in which a plug 12 may be threadably inserted. As shown in FIG. 2, the inlet passageway for the pump housing leads to the high pressure chamber 14 defined by an internal partition 16 more easily seen in FIG. 3. The high pressure chamber 14 communicates via a passageway 18 to the horizontal bore 20 of FIG. 1 in which the valve assembly 22 is mounted as shown in FIG. 2.

Figure 5:
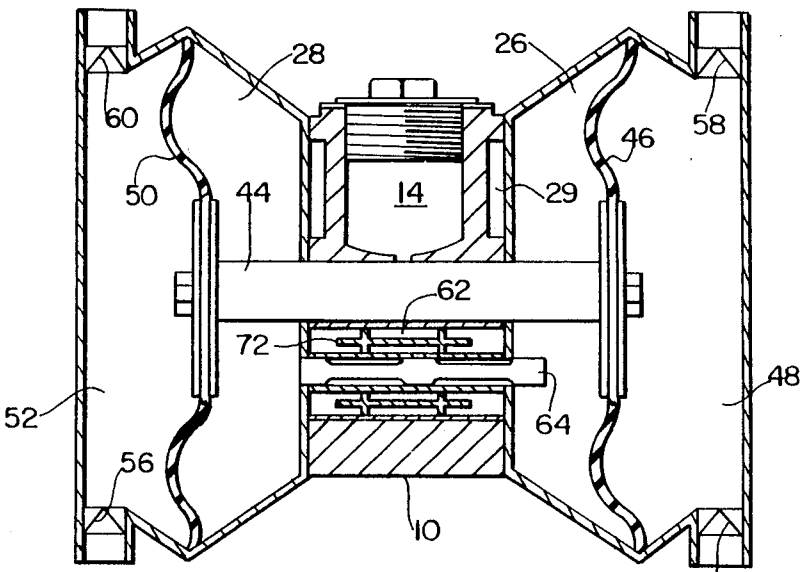
FIGS. 4, 5 and 6 are pictorial views in vertical cross-section illustrating the operation of the pump, and showing the position of the valve piston and the pilot valve piston.
Figure 6:
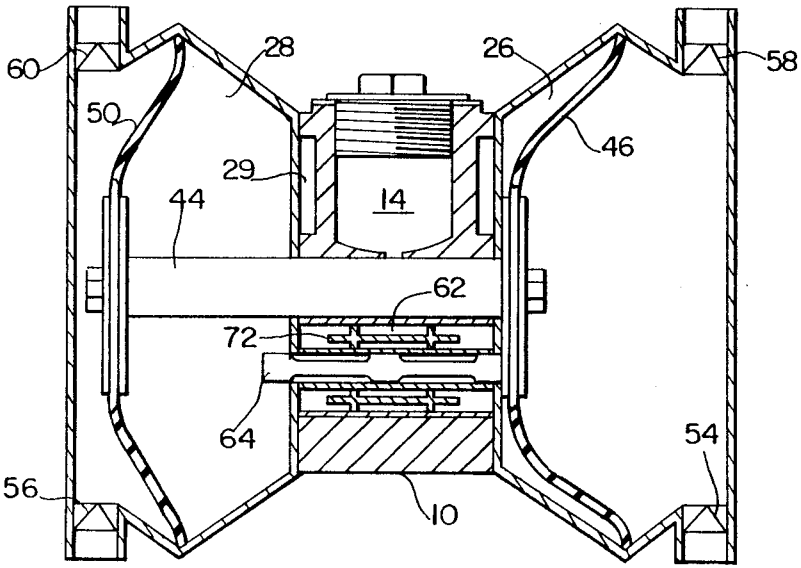
Figure 4:
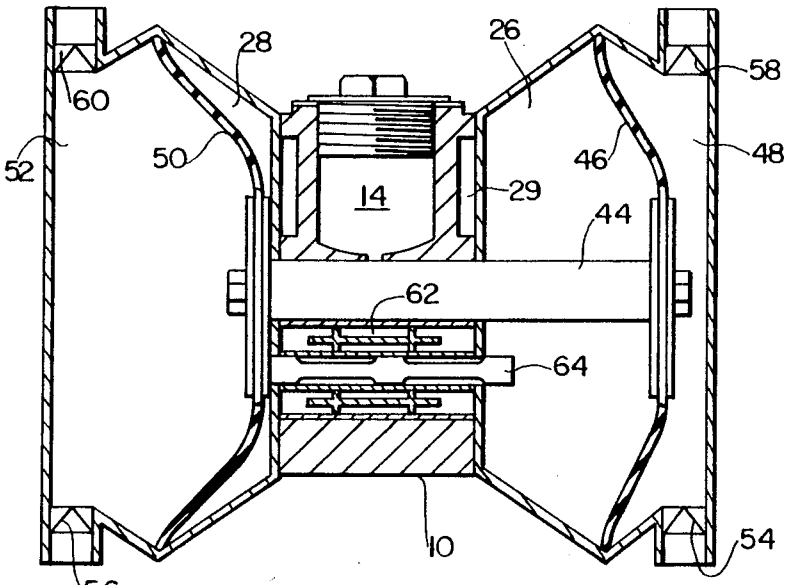

As shown more clearly in FIGS. 1 and 3, the portion of the block 24 external of the partition 16, together with the side plates of the pressure compartments 26 and 28 illustrated in FIGS. 4-6, but omitted for clarity in FIGS. 1-3, define a low pressure chamber 29 which communicates with the bore 20 by an aperture 30 as shown in FIG. 1.

With continued reference to FIGS. 1 and 3, a passageway 32 is provided from the low pressure chamber 29 to the high pressure chamber 14. A needle valve 36 in a valve seat 34 may be manually adjustable externally of the housing by rotating the end 38 of the needle valve 36 in the threads 40 to regulate the amount of air bled from the high pressure chamber 14 to the low pressure chamber 29.

With reference to FIGS. 4-6, the pump housing 10 may be mounted between left and right lateral chambers divided respectively by a flexible diaphragm 50 into a driving chamber 28 and the pumping chamber 52, and by diaphragm 46 into a chamber 26 and a pumping chamber 48. Entrance of the material being pumped into the pumping chambers 48 and 52 respectively may be provided by suitable conventional one-way valves 54 and 56. Similarly, egress from the pumping chambers 48 and 52 may be respectively provided by any suitable conventional one-way valves 58 and 60.

As shown in FIGS. 4-6, the diaphragms 46 and 50 may be connected in a suitable conventional manner by the piston 44 slidably mounted within the central bore 42 of the housing shown in FIG. 1.

In operation and with reference to FIGS. 1-6, the application of compressed air or other motive fluid from the high pressure chamber 14 through the air distribution valve 62 to the chamber 26 forces the diaphragm 46 to the extreme right as shown in FIG. 4 to pump fluid therefrom through the valves 58. At the same time, the motive fluid within the chamber 28 is vented through the orifice 30 of FIG. 1 and the air distribution valve 62 to the low pressure chamber 29 and thence to the atmosphere. This venting allows the chamber 28 to collapse as the chamber 26 is filled and to create a suction which draws fluid through the valve 56 into the pumping chamber 52.

At the end of the pumping stroke, and as shown in FIG. 4, the pilot piston 64 of the valve assembly 62 is mechanically forced to the right by the movement of the diaphragm 50. As will be later explained in greater detail, the movement of the piston 64 to the right effects the operation of the air distribution valve to cause air to be applied from the high pressure chamber 14 of FIG. 5 to fill the chamber 28 and to vent the chamber 26. As shown in FIG. 5, the piston 64 of the pilot valve remains in this extreme right position as the diaphragm piston 44 completes its movement to the left, at which time the diaphragm 46 mechanically moves the piston 64 to the left as shown in FIG. 6. Movement of the piston 64 of the pilot valve to the left as shown in FIG. 6 effects movement of the piston 72 of the air distribution valve 62 to the right to effect a further cycle of the pump as will be subsequently explained.

Typical operating air pressure is about 70 to 100 psi from the compressor and is desirably about 80-85 psi within the high pressure chamber 14. The high pressure chamber 14 serves to reduce turbulence and may house a filter. The pressure of the motive gas in the low pressure chamber 29 is generally about 20 psi. The adjustment of the needle valve 36 is largely a function of temperature and the quality of the motive gas, and generally comprises less than about eighteen percent of the volume of the low pressure chamber 29.

With reference to FIGS. 7 and 8, the preferred embodiment of the air distribution valve 62 comprises a cylinder 70 and is fitted with end caps 71 and 73. The air distribution valve piston 72 is slidably mounted for reciprocating movement within the cylinder 70 between the end caps 71 and 73, with the projections 75 and 77 providing a seal. In this way, the movement of the piston 74 within the valve cylinder 70 is essentially frictionless and the use of seals avoided. Similarly, the movement of the pilot piston 64 within the sleeve 74 is essentially frictionless and the use of seals likewise avoided.

The valve piston 72 internally receives a cylindrical sleeve 74 which together with the end caps 71 and 73 and the cylinder 70 define the housing within which the piston 72 reciprocates. In turn, the sleeve 74 receives the pilot valve piston 74.

The cylinder 70 and the pilot piston 64 may be made of a suitable ferrous alloy. The piston 72 and end caps 71 and 73 are desirably made of a relatively light weight plastic material such as polytetrafluorethylene (PTFE) or other low friction coefficient material. The sleeve 74 may also be manufactured of a low friction coefficient material.

As shown more clearly in FIG. 9, the end caps 71 and 73 serve to maintain the sleeve 74 longitudinally immobile as the pilot piston 64 reciprocates therein.

As understood, the operation of the air distribution valve 64 of FIGS. 7 and 8 may be more readily understood by reference to FIG. 9. With reference to FIG. 9(A), air from the high pressure chamber 14 of the FIGS. 2-6 may be applied through the passageway 18 of FIG. 2 into a longitudinally centered annular cavity and thence through the aperture 80 of FIGS. 2 and 7 into the internal annular chamber 82 of FIG. 9(A). This high pressure air may then flow out of one of the apertures 84 through a passageway 85 in FIG. 1 into the driving chamber 26 of FIG. 4 because of the position of the piston 72 to the left.

At the same time, the apertures 86 in the cylinder 70 provide an exit route for the air from the driving chamber 28 of FIG. 4 into the annular cavity 88 of FIG. 9(A) to the low pressure chamber 29 of FIGS. 1 and 3, and thence through the passageway 85 of FIG. 1 to the atmosphere.

With continued reference to FIG. 9(A), the piston 72 is maintained in the left hand position by the high pressure air within the cavity 82 applying pressure as shown by the arrow 90.

As the chamber 26 fills with high pressure air as shown in FIG. 5, the fluid within the pumping chamber 48 is discharged through the valve 58 and additional fluid enters the chamber 52 through the valve 56. As the piston 44 completes its reciprocating movement to the right, the diaphragm 46 pushes the piston 64 of the pilot valve from the position illustrated in FIGS. 4 and 5 to the position illustrated in FIGS. 6, 9(B) and 9(C). Movement of the pilot valve into the position shown in FIG. 9(B) removes the force represented in FIG. 9(A) by the arrow 90, but leakage from the central chamber 82 into the left chamber as shown by the arrow 103 creates as a result of the deformation of the sleeve 74 the force represented by the arrow 92. Thus, the piston 72 is moved to the right as shown in FIG. 9(C).

In the piston position illustrated in FIG. 9(C), the high pressure air enters through the aperture 80 into the cavity 82 and exits through the apertures 86 to the chamber 28. The pressure of the air within the cavity 82 acts, as shown by the arrows 96, to maintain the piston 72 in the right hand position. In the piston position shown in FIG. 9(C), the air from the chamber 26 passes through the aperture 84 in the cylinder 70 into the low pressure chamber 29 and thence to the atmosphere.

The sleeve 74 is made of a material deformable under a pressure of about sixty percent of the operating pressure of the pump, e.g., about 55 to 60 psi. This pressure deformation serves to effect leakage between the piston 72 and the sleeve 74 when the sleeve 74 is not supported by the pilot piston 64, e.g., as shown by the arrow 102 in FIG. 9(B). This leak is effective to prevent stalling by reducing the likelihood of equal and opposite pressures in adjacent cavities within the valve. In addition, the leak decreases the pressure differential tending to move the piston 72 and thus slows the reciprocating movement of the piston slightly, reducing impact with the end caps and the possibility of deformation and/or sticking of the plastic surfaces.

These and many more advantages will be readily apparent to one skilled in the relevant art. The invention is defined in the appended claims, the scope of which is therefore to include, without limitation, the exemplary embodiments disclosed in the foregoing specification when given a wide range of equivalents.

What is claimed is:

1. A gas operated dual diaphragm pump comprising:

a gas inlet aperture for fluid communication with a supply of compressed gas;

a high pressure chamber in fluid communication with said inlet aperture;

an outlet aperture adapted for fluid communication to the atmosphere;

a low pressure chamber in fluid communication with said outlet aperture;

first and second diaphragm chamber;

a distribution valve in selective fluid communication with said high pressure chamber, said low pressure chamber and said diaphragm chambers; and means for bleeding gas from said high pressure chamber to said low pressure chamber without passing through said gas distribution valve.

2. The pump of claim 1 wherein said gas bleeding means is manually adjustable.

3. In a compressed air operated dual diahragm pump comprising an inlet aperture, a high pressure chamber, an air distribution valve, two diaphragm controlled pumping chambers, a low pressure chamber and an outlet aperture, the improvement comprising means for bleeding air from said high pressure chamber to said low pressure chamber to thereby reduce the pressure differential between said high pressure chamber and said low pressure chamber and increase the pressure differential between said low pressure chamber and said outlet aperture thereby reducing the tendency of the pump to ice.

4. The pump of claim 3 wherein said gas bleeding means is manually adjustable.

5. In a gas driven diaphragm pump comprising a high pressure chamber containing a compressed gas, a gas distribution valve to direct said gas from said high pressure chamber to a pumping compartment, a low pressure chamber to receive said gas vented from said pumping compartment and an outlet aperture to the atmosphere, a method of reducing icing of the outlet aperture comprising the step of providing a passage between the high pressure chamber and the low pressure chamber to increase the pressure differential between the low pressure chamber and the atmosphere and thus the velocity of the gas through the outlet aperture.

6. In a gas driven diaphragm pump comprising a high pressure chamber containing a compressed gas, a gas distribution valve to direct said gas from said high pressure chamber to a pumping compartment, a low pressure chamber to receive said gas vented from said pumping compartment and an outlet aperture to the atmosphere, a method of reducing icing of the distribution valve comprising the step of providing a passage between the high pressure chamber and the low pressure chamber to decrease the pressure differential between the high pressure chamber and the low pressure chamber.

7. A three-way valve operable in response to movement of a pilot valve piston comprising:

a stationary housing;

a reciprocating valve piston; and a reciprocating pilot valve piston, a portion of said housing being elastically deformable under pressure to leak and thereby prevent stalling as a result of equal and opposite pressures and to slow the movement of said valve piston.

8. The valve of claim 7 wherein said housing includes a metallic outer cylinder, a plastic inner cylinder and two plastic end caps; and wherein said pilot piston is metallic.

9. The valve of claim 8 wherein said piston is responsive to the position of said pilot piston.

10. The valve of claim 7 wherein said elastically deformable portion of said housing is deformable at about sixty percent of the normal pressure of the valve.

11. A compressd air driven dual diaphragm pump comprising:

a housing defining high pressure and low pressure chambers;

two flexible diaphragm driven pumping chambers with valve-controlled fluid inlet and outlet ports;

a control valve to admit compressed air from said high pressure chamber to alternately drive one of said pumping chambers and to vent the other of said pumping chambers through said low pressure chamber; and a regulated passage connecting said high pressure chamber to said low pressure chamber without passing through said control valve.

12. The pump of claim 11 wherein said control valve comprises:

a stationary housing;

a reciprocating valve piston; and a reciprocating pilot valve piston, a portion of said housing being elastically deformable under pressure to leak and thereby prevent stalling as a result of equal and opposite pressures and to slow the movement of said valve piston.

13. The pump of claim 12 wherein said deformation occurs at about sixty percent of the pressure of said high pressure chamber.

14. The pump of claim 13 wherein said housing includes a metallic outer cylinder, a plastic inner cylinder and two plastic end caps; and wherein said pilot piston is metallic.

15. A compressed air operated dual diaphragm pump comprising:

an inlet aperture adaptable for connection to a source of compressed air;

an air outlet aperture to the atmosphere;

two diaphragm pumping chambers; and an air distribution valve operable in response to the movement of the diaphragm within the pumping chambers to control the distribution of air to said pumping chambers, said air distribution valve comprising:

a housing having coaxial inner and outer cylindrical walls closed at both ends, said outer wall including a longitudinally centered aperture in communication through said air inlet aperture with a source of compressed air, two longitudinally spaced apertures communicating respectively with said pumping chambers, and two longitudinally spaced apertures communicating with said outlet aperture, and said inner wall being resiliently deformable under pressure and having three longitudinally spaced apertures;

a piston slidably mounted for reciprocating movement within said housing to connect:

when in a first position said longitudinally centered aperture with one of said pumping chamber apertures and the other of said pumping chamber apertures with one of said outlet aperture communicating apertures, and when in a second position said longitudinally centered aperture with said other of said pumping chamber apertures and said one pumping chamber aperture with the other of said outlet aperture communicating apertures; and a pilot piston mounted for reciprocating motion within said inner wall in response to the expansion and contraction of said pumping chambers, said pilot piston configured to cooperate with the apertures in said inner wall to effect the reciprocation of said piston between said first and second positions and to permit the resilient deformation of said inner wall under pressure to bleed compressed air into position within said housing to oppose the movement of said valve member and reduce the likelihood of stalling.

16. The pump of claim 15 wherein the outer wall of said valve housing is metallic;

wherein the inner wall and the closed ends of said valve housing are plastic;

wherein said piston is plastic; and wherein said pilot piston is metallic.

17. The pump of claim 16 wherein said inner wall is deformable at about sixty percent of the operating air pressure.

* * * * *

UNITED STATES PATENT AND TRADEMARK OFFICE

CERTIFICATE OF CORRECTION

PATENT NO. : 4,566,867

DATED : January 28, 1986

INVENTOR(S) : Bazan et al.

It is certified that error appears in the above—identified patent and that said Letters Patent is hereby corrected as shown below:

Column 1, line 34 change "velocity" to --volume--

Signed and Sealed this

*Third* Day of *June 1986*

[SEAL]

*Attest:*

DONALD J. QUIGG

*Attesting Officer*

*Commissioner of Patents and Trademarks*